US010762858B2

(12) United States Patent
Kim et al.

(10) Patent No.: US 10,762,858 B2
(45) Date of Patent: Sep. 1, 2020

(54) DISPLAY DEVICE AND DRIVING METHOD OF DISPLAY DEVICE

(71) Applicant: Samsung Display Co., Ltd., Yongin-si (KR)

(72) Inventors: Hong-Kyu Kim, Suwon-si (KR); Myeong Su Kim, Hwaseong-si (KR); Po-Yun Park, Seoul (KR); Gwang Soo Ahn, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 24 days.

(21) Appl. No.: 15/812,451

(22) Filed: Nov. 14, 2017

(65) Prior Publication Data

US 2018/0144697 A1 May 24, 2018

(30) Foreign Application Priority Data

Nov. 18, 2016 (KR) ..... 10-2016-0154122

(51) Int. Cl.
*G09G 3/36* (2006.01)
*G09G 3/20* (2006.01)
*G09G 5/00* (2006.01)

(52) U.S. Cl.
CPC ..... *G09G 3/3607* (2013.01); *G09G 3/2096* (2013.01); *G09G 5/00* (2013.01); *G09G 2310/08* (2013.01); *G09G 2320/0204* (2013.01); *G09G 2320/0233* (2013.01); *G09G 2320/0242* (2013.01)

(58) Field of Classification Search
USPC ..... 345/691
See application file for complete search history.

(56) References Cited

U.S. PATENT DOCUMENTS

2006/0132493 A1* 6/2006 Akima ..... G09G 3/006 345/520
2007/0229418 A1* 10/2007 Yun ..... G09G 3/2092 345/87
2008/0122813 A1* 5/2008 Kim ..... G09G 3/3648 345/204
2008/0309818 A1* 12/2008 Weng ..... H04N 9/045 348/537
2009/0046091 A1* 2/2009 Arai ..... G09G 5/003 345/214

(Continued)

FOREIGN PATENT DOCUMENTS

KR 1020100095250 8/2010
KR 1020150078981 7/2015
KR 1020160017871 2/2016

*Primary Examiner* — Chineyere D Wills-Burns
(74) *Attorney, Agent, or Firm* — Cantor Colburn LLP

(57) ABSTRACT

A display device includes a display panel including: a plurality of pixels; and a signal controller which generates, on a frame-by-frame basis, a display signal based on an input image signal and a control signal from an outside. The signal controller includes a memory which stores a preset image signal, a receiver which receives the control signal, a clock signal modulator which generates an internal clock signal having a first frequency during a blank period, which is determined based on the control signal in a frame period, and a data processor which reads the preset image signal from the memory in response to the internal clock signal for an image processing.

17 Claims, 8 Drawing Sheets

(56) References Cited

U.S. PATENT DOCUMENTS

| | | | | |
|---|---|---|---|---|
| 2009/0167750 | A1* | 7/2009 | Hong | G09G 3/2096 345/213 |
| 2009/0174691 | A1* | 7/2009 | Yeo | G09G 5/008 345/204 |
| 2009/0201272 | A1* | 8/2009 | Ahn | H03K 9/08 345/204 |
| 2010/0053146 | A1* | 3/2010 | Han | G09G 3/2096 345/214 |
| 2011/0234608 | A1* | 9/2011 | Funada | H04N 5/04 345/545 |
| 2012/0162185 | A1* | 6/2012 | Park | G09G 3/3611 345/212 |
| 2012/0169698 | A1* | 7/2012 | Park | G09G 3/3648 345/211 |
| 2013/0038621 | A1* | 2/2013 | Choi | G06T 1/60 345/589 |
| 2013/0147864 | A1 | 6/2013 | Km et al. | |
| 2015/0022512 | A1* | 1/2015 | Ahn | G09G 3/3614 345/212 |
| 2017/0315652 | A1* | 11/2017 | Pourbigharaz | G06F 3/005 |

* cited by examiner

DISPLAY DEVICE AND DRIVING METHOD OF DISPLAY DEVICE

This application claims priority to Korean Patent Application No. 10-2016-0154122, filed on Nov. 18, 2016, and all the benefits accruing therefrom under 35 U.S.C. § 119, the content of which in its entirety is herein incorporated by reference.

BACKGROUND

(a) Field

Exemplary embodiments of the disclosure relate to a display device and a driving method of the display device.

(b) Description of the Related Art

A display device typically includes a display panel in which a plurality of pixels, a plurality of gate lines, and a plurality of data lines are disposed, a gate driver for outputting a gate signal to the gate lines, and a data driver for outputting a data voltage to the data lines.

The display device may further include a signal controller for controlling the gate driver and the data driver. The signal controller appropriately processes input image signals and control signals to generate signals controlling the gate driver and the data driver and to transmit image data to a data supply unit.

The signal controller receives an operation voltage. When the signal controller performs an image process, the signal controller operates with a high load. When the signal controller does not perform the image process, the signal controller operates with a low load.

SUMMARY

In a display device, when the operation load of a signal controller is changed from a high load to operate with a low load, or vice versa, a ripple may be generated on an operation voltage thereof due to the load change.

Exemplary embodiments relate to a display device and a driving method for the display device in which operation voltage is stably supplied to a signal controller.

Exemplary embodiments relate to a display device and a driving method for the display device in which damage of a data processed in a signal controller is effectively prevented.

An exemplary embodiment of a display device includes: a display panel including a plurality of pixels; and a signal controller which generates, on a frame-by-frame basis, a display signal based on an input image signal and a control signal from an outside, where the signal controller includes a memory which stores a preset image signal, a receiver which receives the control signal, a clock signal modulator which generates an internal clock signal having a first frequency during a blank period, which is determined based on the control signal within one frame period, and a data processor which reads the preset image signal from the memory in response to the internal clock signal for an image processing.

In an exemplary embodiment, the control signal may include a data enable signal including a pulse having an enable level during an active period and a pulse having a disable level during the blank period, where the active period is a remaining period in the frame period other than the blank period, and a main clock signal having a frequency equal to or higher than the first frequency.

In an exemplary embodiment, the internal clock signal may have a frequency equal to or higher than the first frequency during an active period, which is determined based on the control signal in the frame period.

In an exemplary embodiment, the data processor may perform the image processing for the input image signal during the active period, and the signal controller may further include a transmitter which outputs the input image signal after the data processor performs the image processing therefor.

In an exemplary embodiment, the first frequency of the internal clock signal may vary during the blank period.

In an exemplary embodiment, the clock signal may have at least three different frequencies during the blank period.

In an exemplary embodiment, the image processing may include at least one of a color correction, a luminance non-uniformity correction, a color characteristic compensation (e.g., adaptive color correction ("ACC")) and a dynamic capacitance compensation ("DCC").

In an exemplary embodiment, the memory may store the input image signal of a previous frame, which is input to the signal controller, as the preset image signal.

In an exemplary embodiment, the memory may store the input image signal of a previous frame, for which the image processing is performed by the data processor, as the preset image signal.

In an exemplary embodiment, the memory may further stores correction data to be used for the image processing, and the data processor may include a first data processor which performs the image processing with reference to the correction data of the memory and a second data processor which performs the image processing without reference to the memory.

In an exemplary embodiment, the clock signal modulator may output only the internal clock signal to the first data processor during the blank period.

An exemplary embodiment of a driving method of a display device including a display panel including a plurality of pixels and a signal controller includes: receiving a control signal from an outside by the signal controller; determining a blank period in a frame period by the signal controller based on the control signal; generating an internal clock signal having a first frequency during the blank period by the signal controller; and reading a preset image signal from a memory in response to the internal clock signal by the signal controller for an image processing.

In an exemplary embodiment, the internal clock signal may have a frequency equal to or higher than the first frequency during an active period, which is a remaining period in the frame period other than the blank period.

In an exemplary embodiment, the method may further include receiving the input image signal from the outside by the signal controller, where the signal controller may perform the image processing for the input image signal during the active period to be output to the display panel.

In an exemplary embodiment, the first frequency of the internal clock signal may vary during the blank period.

In an exemplary embodiment, the clock signal may have at least three different frequencies during the blank period.

In an exemplary embodiment, the image processing may include at least one of a color correction, a luminance non-uniformity correction, a color characteristic compensation (e.g., ACC), and a DCC.

According to exemplary embodiments, the ripple of the operation voltage of the signal controller may be substantially reduced or effectively prevented. Therefore, in such embodiments, display quality deterioration of the display device may be effectively prevented.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
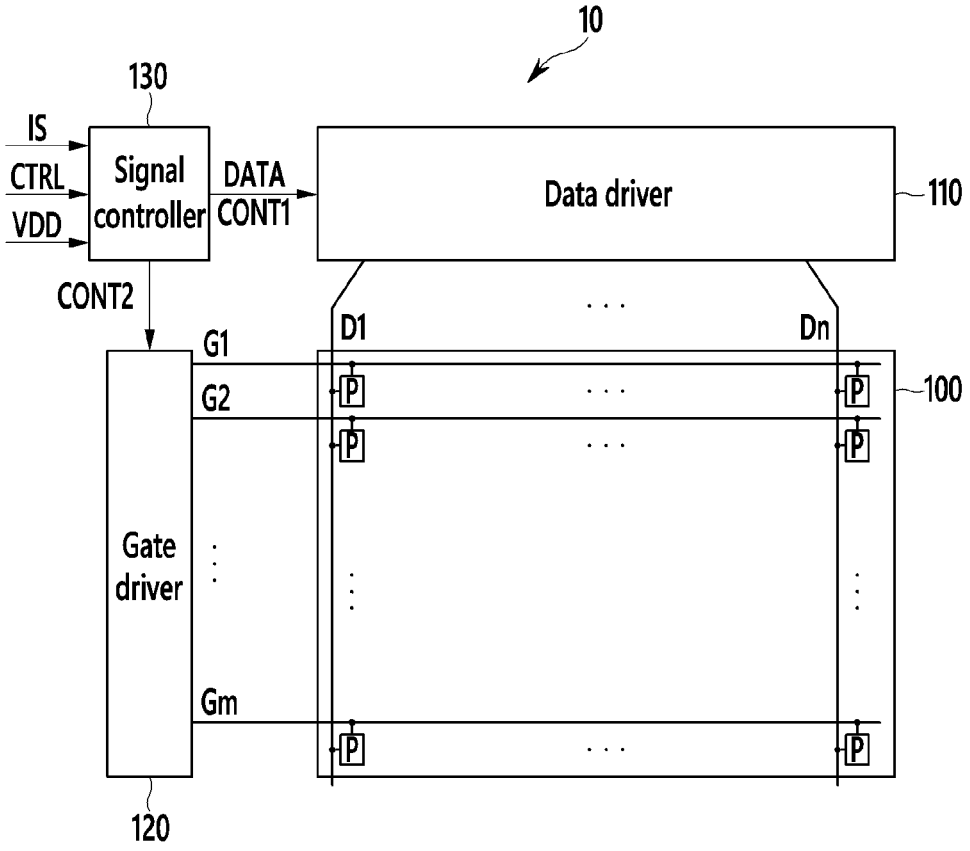
FIG. 1 is a block diagram schematically showing a display device according to an exemplary embodiment.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, exemplary embodiments of the invention will be described in detail with reference to the accompanying drawings.

An exemplary embodiment of a display device 10 will now be described with reference to FIG. 1.

FIG. 1 is a schematic block diagram of a display device according to an exemplary embodiment.

In an exemplary embodiment, as shown in FIG. 1, the display device 10 includes a display panel 100, a data driver 110, a gate driver 120, and a signal controller 130. In such an embodiment, the display device may further include another constituent element in addition to those described above.

The display panel 100 includes a plurality of display signal lines and a plurality of pixels P connected thereto. The plurality of display signal lines includes a plurality of gate lines G1 to Gm that transmits a plurality of gate signals (also referred to as "scanning signals"), and a plurality of data lines D1 to Dn that transmits a plurality of data voltages. Each of the plurality of pixels P may be connected to a corresponding one of the gate lines G1 to Gm and a corresponding one of the data lines D1 to Dn. The plurality of pixels P may include a liquid crystal display element or an organic light emitting element.

The data driver 110 is connected to the plurality of data lines D1 to Dn of the display panel 100 to apply the plurality of data voltages to the plurality of data lines D1 to Dn. In an exemplary embodiment, a data driving IC may generate the data voltages for all gray levels (or brightness levels) by using reference gamma voltages. In such an embodiment, the data driver 110 outputs the generated data voltages as data signals to the data lines D1 to Dn.

The gate driver 120 is connected to the plurality of gate lines G1 to Gm, and applies a plurality of gate signals generated based on a combination of a gate-on voltage and a gate-off voltage to the plurality of gate lines G1 to Gm.

The gate driver 120 applies the plurality of gate signals of the gate-on voltage Von to the plurality of gate lines G1 to Gm by a unit of 1 horizontal period (also referred to as "1H" and that is equal to one period of a horizontal synchronization signal and a data enable signal) based on a gate control signal CONT2. The data driver 110 applies the plurality of data voltages to the plurality of pixels P of a corresponding pixel row in synchronization with each applying time of the plurality of gate signals of the gate-on voltage based on a data control signal CONT1.

Although not shown, in an exemplary embodiment, where the display panel 100 is the liquid crystal panel, the display device further includes a backlight unit positioned at a back side of the display panel 100 and including a light source. In one exemplary embodiment, for example, the light source may include a fluorescent lamp such as a cold cathode fluorescent lamp ("CCFL") or a light emitting diode ("LED"). Hereinafter, for convenience of description, exemplary embodiments where the display panel 100 is a liquid crystal panel will be described in detail.

The signal controller 130 controls operations of the gate driver 120, the data driver 110, etc. The signal controller 130 may receive an operation voltage VDD for an operation thereof.

The signal controller 130 receives an input image signal IS and an input control signal CTRL, which are input thereto from an outside or an external device. The input image signal IS includes luminance information of each pixel of the display panel 100, and the luminance may be divided into gray levels of a predetermined number, for example 1024 gray levels, 256 gray levels, or 64 gray levels.

The input control signal CTRL may include a vertical synchronization signal, a horizontal synchronizing signal, a main clock signal, a data enable signal and the like, in accordance with the image display. In an exemplary embodiment, the data enable signal may have a voltage of an enable level during a period, in which the input image signal IS is provided. The main clock signal may be a basis for generating at least one of clock signals to be used for the operation of the signal controller 130. The vertical synchronization signal may be a basis for distinguishing frames of the image, and the horizontal synchronizing signal may be a basis for distinguishing the pixels arranged along the row of the display panel 100.

The signal controller 130 appropriately processes the input image signal IS based on the input image signal IS and the input control signal CTRL to be suitable for the operating conditions of the display panel 100, and may generate a display signal including the image data DATA, the data control signal CONT1, the gate control signal CONT2 and the like, based on the input image signal IS and the input control signal CTRL.

Next, an exemplary embodiment of the signal controller 130 of the display device 10 will be described in detail with reference to FIG. 2.

Figure 2:
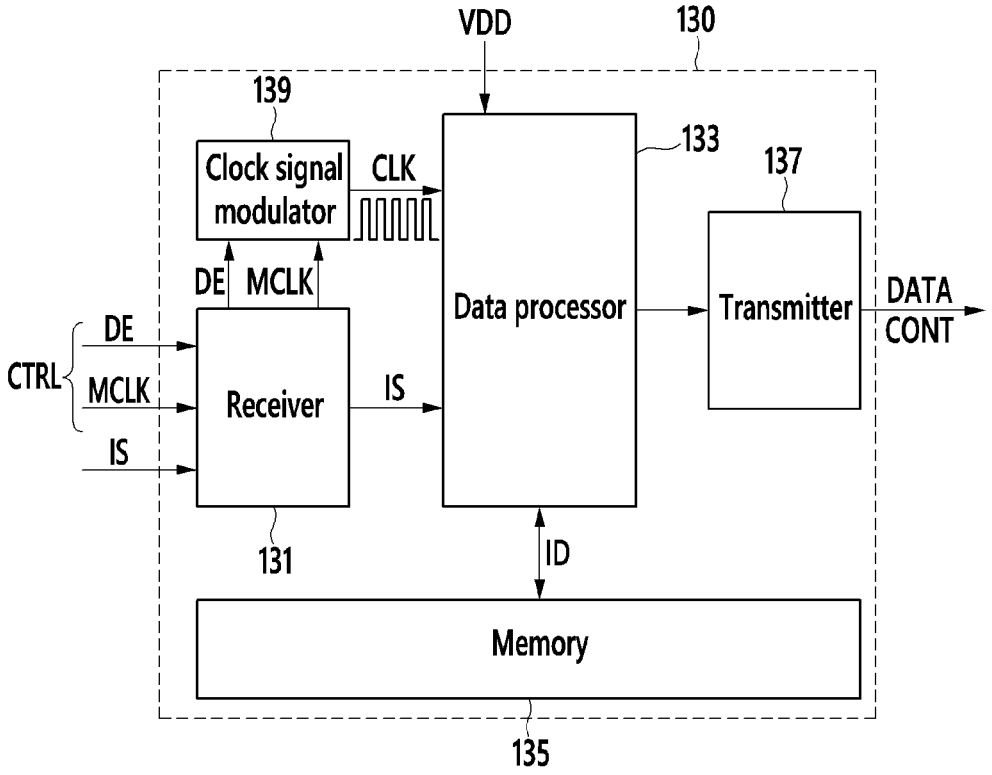
FIG. 2 is a block diagram showing a signal controller of a display device according to an exemplary embodiment.

FIG. 2 is a block diagram showing the signal controller 130 of the display device 10 according to an exemplary embodiment. In an exemplary embodiment, as shown in FIG. 2, an exemplary embodiment of the signal controller 130 includes a receiver 131, a data processor 133, a memory 135, a transmitter 137, and a clock signal modulator 139.

The receiver 131 may receive the input image signal IS and the input control signal CTRL. In an exemplary embodiment, the receiver 131 may receive the input image signal IS on a frame-by-frame basis from an external system based on a predetermined interface method, and be supplied to the data processor 133.

The receiver 131 may also receive the data enable signal DE input from the external system. The data enable signal DE may be input on a frame-by-frame basis. A frame may include an active period and a blank period. The data enable signal DE may be supplied with a pulse form having a predetermined pulse width during the active period. The data enable signal DE may have a disable level during the blank period.

In such an embodiment, the receiver 131 may receive a main clock signal MCLK. The main clock signal MCLK may be provided from the external system, or may be generated by an oscillator that may be included in the display device 10.

The receiver 131 may transmit the data enable signal DE and the main clock signal MCLK to the clock signal modulator 139.

In an exemplary embodiment, the data processor 133 receives the input image signal IS through the receiver 131 and receives a clock signal CLK through the clock signal modulator 139. The data processor 133 may operate based on the operation voltage VDD and may process the input image signal IS based on the clock signal CLK.

In one exemplary embodiment, for example, the data processor 133 may perform a color correction, a luminance non-uniformity correction, an adaptive color correction ("ACC"), a dynamic capacitance compensation ("DCC") and the like for the input image signal IS.

The data processor 133 may process the input image signal IS by using the data ID stored in the memory 135. Alternatively, the data processor 133 may process the input image signal IS without using the data ID stored in the memory 135.

An exemplary embodiment where the input image signal IS is processed by using the memory 135 will now be described.

In such an embodiment, the data processor 133 may correct the color of the input image signal IS provided from the receiver 131. In one exemplary embodiment, for example, the data processor 133 receives color correction data stored in the memory 135 and corrects the color of the input image signal IS from the receiver 131. In such an embodiment, the data processor 133 corrects at least one of red (R), green (G) and blue (B) data of the input image signal IS by using the color correction data. In such an embodiment, the color correction data may be predetermined in accordance with the characteristics of the display panel 100 when manufacturing the display panel 100, to be stored to the memory 135.

The data processor 133 may also correct the luminance non-uniformity of the image that may be displayed by the input image signal IS. The data processor 133 receives the luminance non-uniformity correction data stored in the memory 135 and corrects the luminance non-uniformity of the input image signal IS input from the receiver 131. The luminance non-uniformity correction data may also be predetermined according to the characteristics of the display panel 100 when manufacturing the display panel 100, to be stored to the memory 135.

The data processor 133 may also perform the DCC of compensating a gray value of the input image signal IS of the current frame based on the image signal of a previous frame stored in the memory 135 and the input image signal IS of a current frame input through the receiver 131. In general, a speed that liquid crystal molecules included in a liquid crystal layer are rearranged is slower than a speed of the change of the voltage applied to the pixel P. That is, even if the voltage applied to the pixel P is changed on a frame-by-frame basis, the liquid crystal molecules are completely rearranged by the voltage per frame. Accordingly, in such an embodiment, the data processor 133 may increase the gray value of the input image signal IS of the current frame to compensate the response speed of the liquid crystal molecule. The data processor 133 receives the image signal of the previous frame stored to the memory 135, and compares the input image signal IS of the current frame input from the receiver 131 to compensate the response speed associated thereto. The data processor 133 compensates the gray of the input image signal IS of the current frame based on the predetermined DCC data depending on the gray difference of the image signal of the previous frame and the input image signal IS of the current frame. In such an embodiment, the DCC data may be stored in the memory 135.

In an exemplary embodiment, where the input image signal IS is processed without using the memory 135, the data processor 133 may process the input image signal IS by up-scaling or a down-scaling to be suitable for the display panel 100. Such a scaling processing may be performed without reference to the memory 135.

In an exemplary embodiment, the memory 135 may include a non-volatile memory such as an electrically erasable programmable read-only memory ("EEPROM"), and may store data such as resolution and timing information, color correction data, luminance non-uniformity correction data, DCC data, a preset image signal, etc. The memory 135 may further include a volatile memory 135 such as a dynamic random-access memory ("DRAM"), and may store at least one of data among a color corrected image signal, a luminance non-uniformity corrected image signal, and a previous frame image signal.

The clock signal modulator 139 may receive the data enable signal DE and the main clock signal MCLK from the receiver 131. The clock signal modulator 139 may generate the clock signal CLK based on the data enable signal DE.

In an exemplary embodiment, the clock signal modulator 139 modulates the main clock signal MCLK into the clock signal CLK having a first frequency to be output regardless of the data enable signal DE. In the active period and the blank period, the data processor 133 receives the clock signal CLK having the first frequency.

In an alternative exemplary embodiment, where the data enable signal DE is supplied as the pulse type having a constant pulse width, the clock signal modulator 139 modulates the main clock signal MCLK into the clock signal CLK having the first frequency to be output. When the data enable signal DE is input with the disable level, the clock signal modulator 139 modulates the main clock signal MCLK into the clock signal CLK having a second frequency that is lower than the first frequency to be output. Thus, the data processor 133 receives the clock signal CLK having the first frequency in the active period and receives the clock signal CLK having the second frequency in the blank period.

In another alternative exemplary embodiment, where the data enable signal DE is supplied as the pulse type having a constant pulse width, the clock signal modulator 139 modulates the main clock signal MCLK into the clock signal CLK having the first frequency to be output. When the data enable signal DE is input with the disable level, the clock signal modulator 139 modulates the main clock signal MCLK into the clock signal CLK having a predetermined frequency in a range of the first frequency to a third frequency that is lower than the first frequency to be output. Thus, the data processor 133 receives the clock signal CLK having the first frequency in the active period and receives the clock signal CLK having the predetermined frequency in a range of the first frequency to the third frequency in the blank period.

The transmitter 137 may output the image data DATA processed in the data processor 133. The image data DATA is provided to the data driver 110 and is written as the data signal to the pixel P, thereby displaying an image. The transmitter 137 may further output the output control signal CONT. In one exemplary embodiment, for example, the output control signal CONT may include the data control signal CONT1 and the gate control signal CONT2.

An exemplary embodiment of a driving method of the display device 10 including the above-configured signal controller 130 will now be described with reference to FIG. 3.

Figure 3:
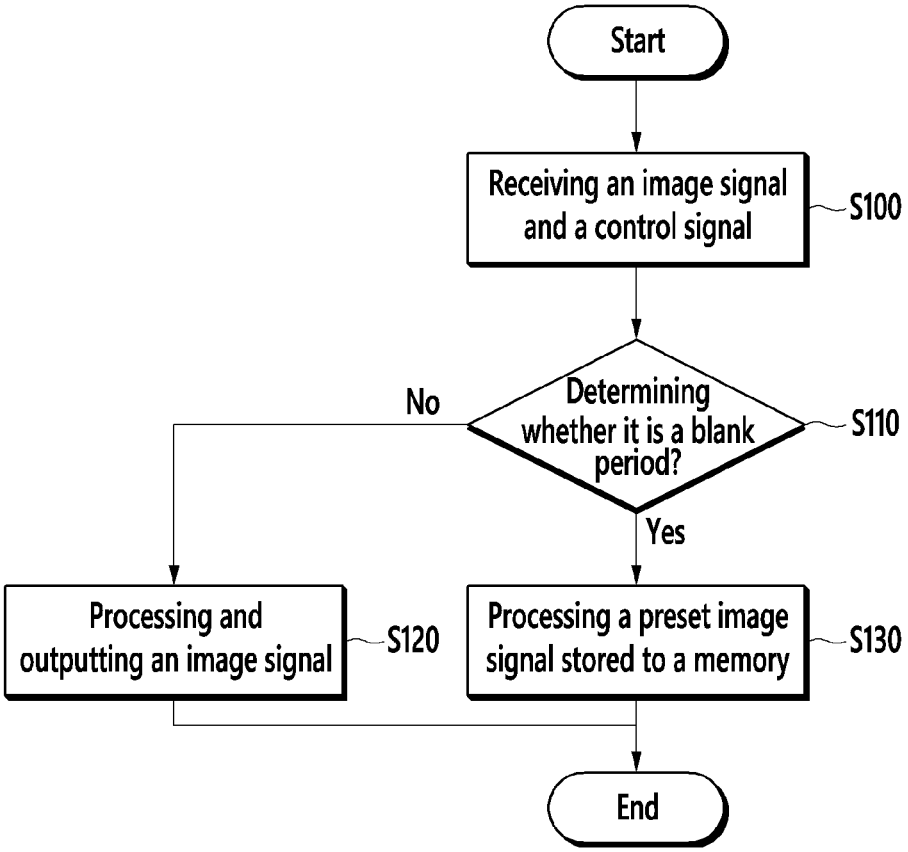
FIG. 3 is a flowchart showing a driving method of a display device according to an exemplary embodiment.

FIG. 3 is a flowchart showing a driving method of a display device 10 according to an exemplary embodiment. In an exemplary embodiment of the driving method, a control signal is received from the external system (S100). In one exemplary embodiment for example, the receiver 131 receives the input control signal CTRL from the external system. The input control signal CTRL may include the main clock signal MCLK and the data enable signal DE. In such an embodiment, while the data enable signal DE is input as the pulse type having the enable level, the input image signal IS may be further input to the receiver 131.

In an exemplary embodiment, whether it is the blank period is determined based on the data enable signal DE (S110). In one exemplary embodiment, for example, the clock signal modulator 139 determines whether it is the blank period based on the data enable signal DE. The clock signal modulator 139 may modulate the clock signal CLK based on the data enable signal DE to be output to a data output unit.

The data processor 133 receives the clock signal CLK having the first frequency during a period other than the blank period, that is, an active period, in which the data enable signal DE is input as the pulse type having the enable level. In an exemplary embodiment, the image signal is processed and output during the active period (S120). In one exemplary embodiment, for example, the data processor 133 processes the data of the input image signal IS to be output as the image data DATA.

In an exemplary embodiment, the data processor 133 receives the clock signal CLK having the first frequency, the second frequency, or the predetermined frequency in a range of the first frequency to the third frequency during the blank period in which the data enable signal DE has the disable level. In an exemplary embodiment, a preset image signal stored in a memory is processed during the blank period (S130). In one exemplary embodiment, for example, the data processor 133 processes the preset image signal stored in the memory 135.

In such an embodiment, the preset image signal may be a test image signal stored in the non-volatile memory. Alternatively, the preset image signal may be the input image signal IS of a previous frame, which is stored in the memory 135 for the image processing in the previous frame. In one exemplary embodiment, for example, the preset image signal includes the color corrected image signal, the luminance non-uniformity corrected image signal, and the previous frame image signal.

An exemplary embodiment of a method of processing the preset image signal during the blank period through the data processor 133 will be described with the reference to FIG. 4.

Figure 4:
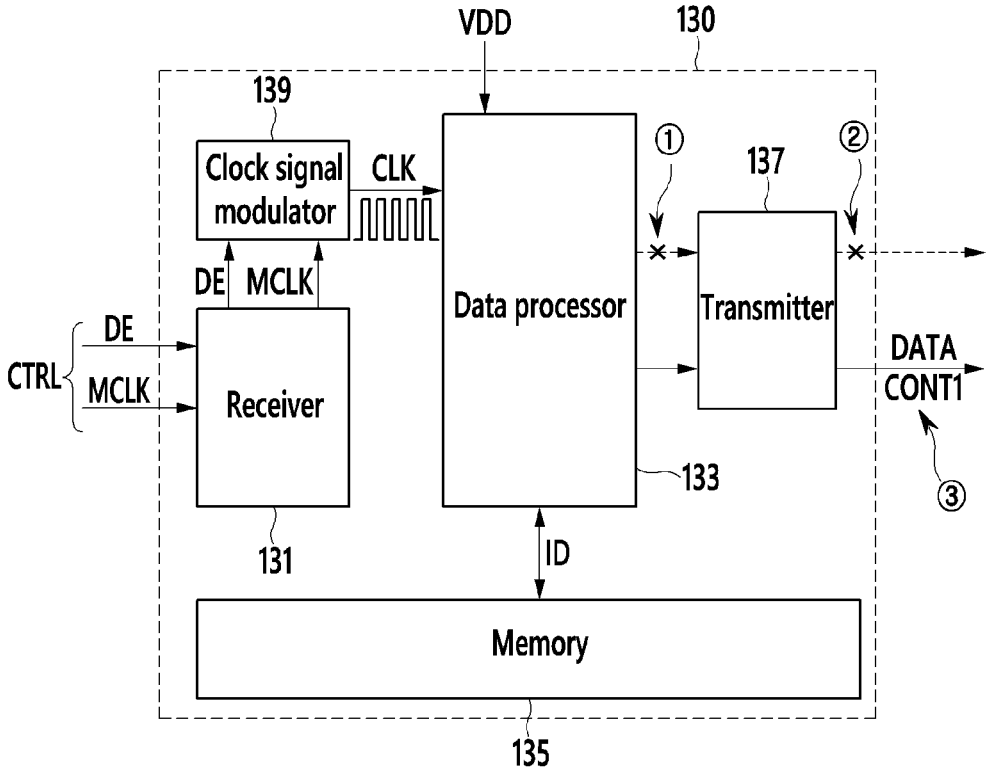
FIG. 4 is a block diagram to explain an operation of a signal controller of a display device in a blank period according to an exemplary embodiment.

FIG. 4 is a block diagram to explain an operation of a signal controller 130 of a display device 10 in a blank period according to an exemplary embodiment.

In an exemplary embodiment, as shown in FIG. 4, the input control signal CTRL is input to the receiver 131 of the signal controller 130. The input image signal IS may not be input to the signal controller 130 during the blank period.

The receiver 131 may output the data enable signal DE and the main clock signal MCLK of the input control signal CTRL to the clock signal modulator 139. Thus, the clock signal modulator 139 may modulate the main clock signal MCLK into the clock signal CLK having the first frequency, the second frequency, or the predetermined frequency in a range of the first frequency to the third frequency to be output to the data processor 133.

The data processor 133 may operate in response to the clock signal CLK input thereto. The data processor 133 reads the data ID to be used for the image processing from the memory 135 in response to the clock signal CLK.

In an exemplary embodiment, the data processor 133 may read the preset image signal from the memory 135. The data processor 133 may perform the image processing for the preset image signal read from the memory 135. In one exemplary embodiment, for example, the data processor 133 may perform the image processing that is performed with reference to the memory 135 for the preset image signal. In an alternative exemplary embodiment, the data processor 133 may perform the image processing that is performed without reference to the memory 135 for the preset image signal.

Thus, the data processor 133 may generate the image data DATA, in which the preset image signal is image-processed, and the control signals CONT1 and CONT2 corresponding thereto.

The data processor 133 may not output the image data DATA and the control signals CONT1 and CONT2 to the transmitter 137 (①).

The data processor 133 outputs the image data DATA based on the preset image signal and the control signals CONT1 and CONT2 to the transmitter 137. The transmitter 137 may not output the image data DATA and control signals CONT1 and CONT2 to the data driver 110 or the gate driver 120 (②).

In such an embodiment, the data processor 133 outputs the image data DATA according to the preset image signal and the control signals CONT1 and CONT2 to the transmitter 137. The transmitter 137 may only output the image data DATA and the data control signal CONT1 to the data driver 110 among the image data DATA and the control signals CONT1 and CONT2 (③).

Accordingly, in such an embodiment, the image-processed data and the control signals are not displayed on the display panel 100 in the blank period.

According to exemplary embodiments of the display device 10 and the driving method of the display device 10, the clock signal CLK is applied to the data processor 133 during the blank period and the data processor 133 processes the data stored in the memory 135. In such an embodiment, the data is processed by the data processor 133 during the blank period, such that the signal controller 130 operates with a relatively high load during the blank period. Accordingly, in such an embodiment, the signal controller 130, which operates with the high load during the active period, also operates with a relatively high load during the blank period, such that a ripple of the operation voltage VDD generated by the load change decreases.

Hereinafter, the frequency of the clock signal CLK output in the clock signal modulator 139 will be described in detail with reference to FIG. 5 to FIG. 7.

Figure 5:
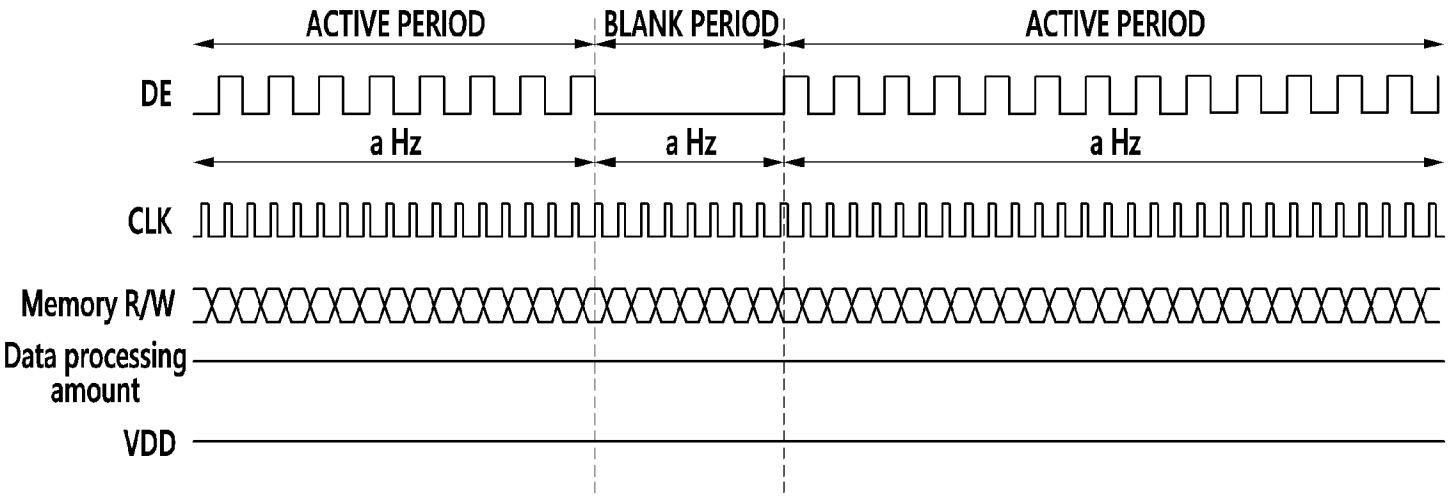
FIG. 5 to FIG. 7 are timing diagrams showing an operation of a signal controller of a display device according to exemplary embodiments.
Figure 6:
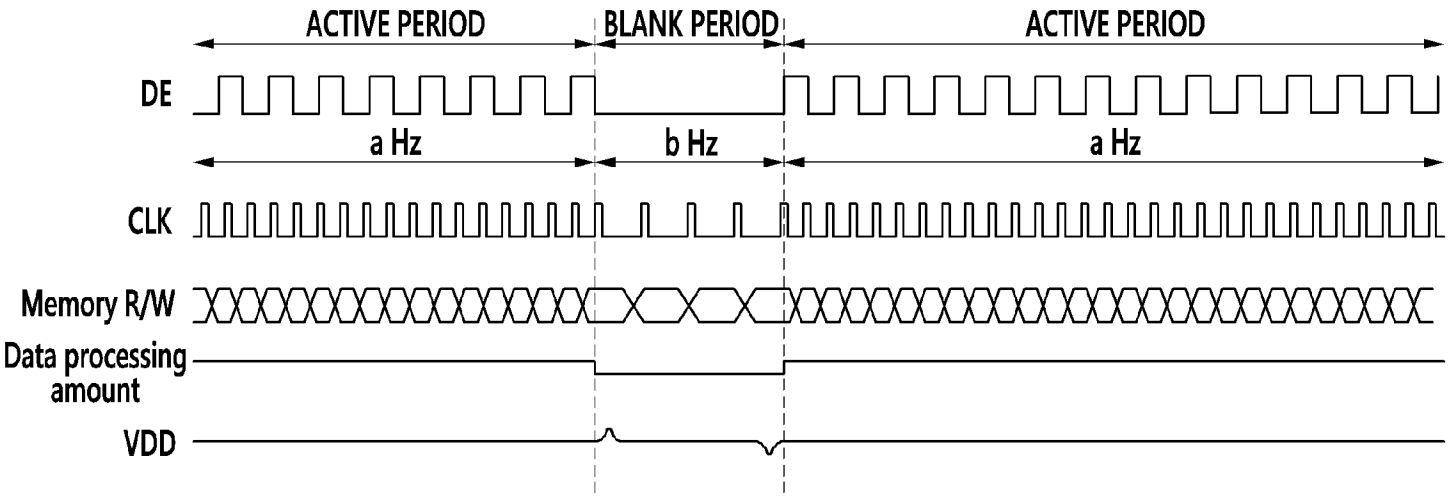
Figure 7:
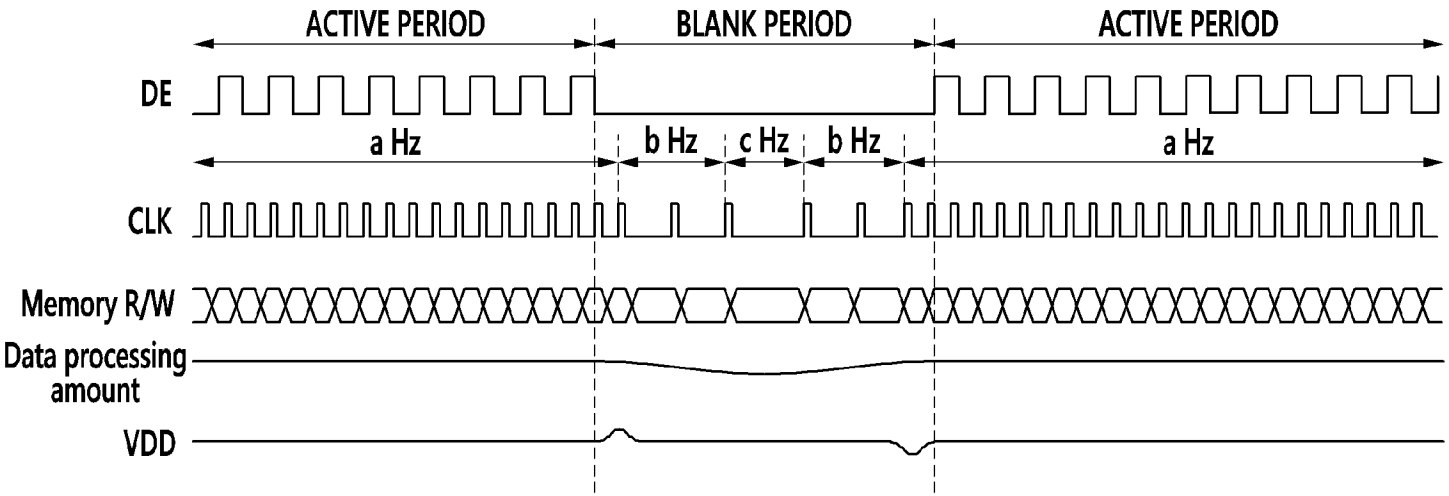

FIG. 5 to FIG. 7 are timing diagrams showing an operation of a signal controller 130 of a display device 10 according to exemplary embodiments.

In an exemplary embodiment, as shown in FIG. 5, the data enable signal DE may be input with the pulse having the constant pulse width during the active period ACTIVE PERIOD, and may be input with the disable level during the blank period BLANK PERIOD.

The clock signal modulator 139 may output the clock signal CLK having a first frequency (a Hz) during the active period ACTIVE PERIOD and the blank period BLANK PERIOD.

The data processor 133 may process the data with reference to the memory 135 within the active period ACTIVE PERIOD and the blank period BLANK PERIOD. The data processor 133 may operate during both the active period ACTIVE PERIOD and the blank period BLANK PERIOD by receiving the clock signal CLK having the first frequency (a Hz). Since the data processor 133 may perform an image processing for the preset data stored in the memory 135 during the blank period BLANK PERIOD, a data processing amount in the blank period BLANK PERIOD and a data processing amount the active period ACTIVE PERIOD are substantially the same as each other. Therefore, the signal controller 130 may operate with the high load in the blank period BLANK PERIOD as in the active period ACTIVE PERIOD. Accordingly, the ripple of the operation voltage VDD supplied to the signal controller 130 is substantially minimized or effectively prevented.

In an alternative exemplary embodiment, as shown in FIG. 6, the clock signal modulator 139 may output the clock signal CLK having the first frequency (a Hz) during the active period ACTIVE PERIOD. The clock signal modulator 139 may output the clock signal CLK having the second frequency (b Hz) that is lower than the first frequency (a Hz) during the blank period BLANK PERIOD.

The data processor 133 may process the data with reference to the memory 135 within the active period ACTIVE PERIOD and the blank period BLANK PERIOD. The data processor 133 may receive the clock signal CLK having the first frequency (a Hz) during the active period ACTIVE PERIOD to operate. The data processor 133 may receive the clock signal CLK having the second frequency (b Hz) during the blank period BLANK PERIOD to operate. The data processor 133 may perform an image-processing for the preset data stored in the memory 135 during the blank period BLANK PERIOD. The signal controller 130 may also operate with the relatively high load even in the blank period BLANK PERIOD as in the active period ACTIVE PERIOD. Accordingly, in such an embodiment, the ripple of the operation voltage VDD supplied to the signal controller 130 may decrease. In such an embodiment, the ripple of the operation voltage VDD supplied to the signal controller 130 may be substantially reduced, while reducing the power consumption thereof.

In another alternative exemplary embodiment, as shown in FIG. 7, the clock signal modulator 139 may output the clock signal CLK having the first frequency (a Hz) during the active period ACTIVE PERIOD. The clock signal modulator 139 may output the clock signal CLK having the predetermined frequency from the first frequency (a Hz) to the third frequency (c Hz) during the blank period BLANK PERIOD. In such an embodiment, in the blank period, the clock signal modulator 139 may output the clock signal CLK having the predetermined frequency (a Hz, b Hz or c Hz) in a range of the first frequency (a Hz) to the third frequency (c Hz). The data processor 133 may process the data with reference to the memory 135 during the active period ACTIVE PERIOD and the blank period BLANK PERIOD. The data processor 133 may receive the clock signal CLK having the first frequency (a Hz) during the active period ACTIVE PERIOD to operate. The data processor 133 may receive the clock signal CLK having the predetermined frequency (a Hz, b Hz or c Hz) during the blank period BLANK PERIOD to operate. The data processor 133 may perform an image-processing for the preset data stored in the memory 135 during the blank period BLANK PERIOD. Even in the blank period BLANK PERIOD, the signal controller 130 may operate with a relatively high load as in the active period ACTIVE PERIOD. Accordingly, the ripple of the operation voltage VDD supplied to the signal controller 130 may decrease. In such an embodiment, the ripple of the operation voltage VDD supplied to the signal controller 130 may be relatively reduced, while further reducing the power consumption thereof.

Next, an alternative exemplary embodiment of a signal controller 130' of the display device 10 will be described with reference to FIG. 8.

Figure 8:
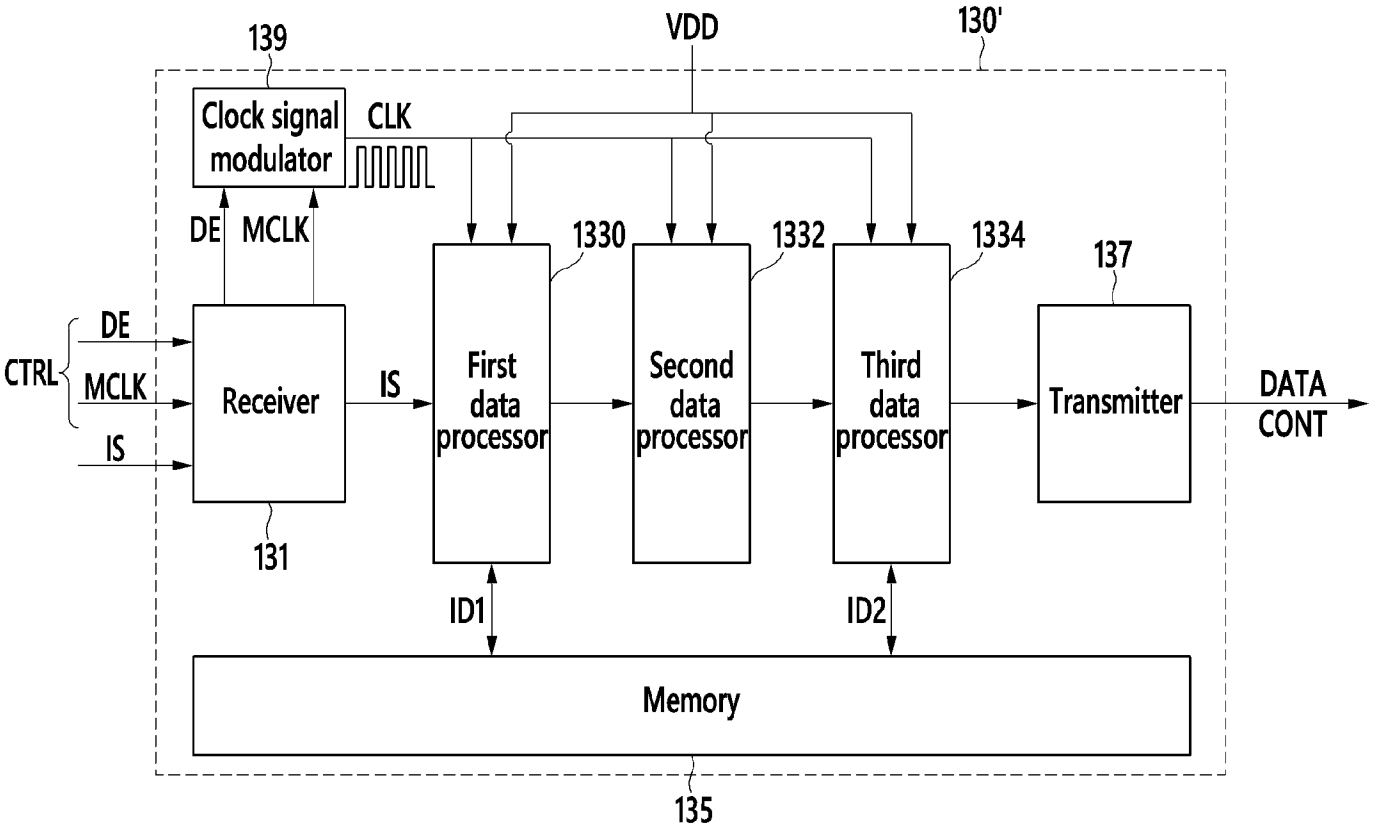
FIG. 8 is a block diagram showing a signal controller of a display device according to an alternative exemplary embodiment.

FIG. 8 is a block diagram of a signal controller 130' of a display device 10 according to an alternative exemplary embodiment. The signal controller 130' of FIG. 8 is substantially the same as or similar to the signal controller 130 of FIG. 2. The same or like elements shown in FIG. 8 have been labeled with the same reference characters as used above to describe the exemplary embodiments of the signal controller 130 shown in FIG. 2, and any repetitive detailed description thereof will hereinafter be omitted or simplified.

In an exemplary embodiment, as shown in FIG. 8, the signal controller 130' includes the receiver 131, first to third data processors 1330, 1332, and 1334, the memory 135, the transmitter 137, and the clock signal modulator 139.

The first data processor 1330 and the third data processor 1334 may process the input image signal IS by using data ID1 and ID2 stored in the memory 135. The second data processor 1332 processes the input image signal IS without using the memory 135.

In one exemplary embodiment, for example, the first data processor 1330 and the third data processor 1334 may perform an image processing including at least one of a color correction, a luminance non-uniformity correction, a color characteristic compensation (e.g., an adaptive color correction ("ACC")), and a DCC. The second data processor 1332 may perform the image processing such as the up-scaling, the down-scaling, etc.

The color correction, the luminance non-uniformity correction, the color characteristic compensation, the DCC, the up-scaling and the down-scaling are the same as those described above with reference to FIG. 2, any repetitive detailed description thereof is omitted.

The first to third data processors 1330, 1332, and 1334 may operate by receiving the operation voltage VDD, and may process the input image signal IS based on the clock signal CLK input thereto.

In an exemplary embodiment, the first data processor 1330 receives the input image signal IS from the receiver 131, and receives the clock signal CLK through the clock signal modulator 139. The first data processor 1330 may process the input image signal IS based on the clock signal CLK. In one exemplary embodiment, for example, the first data processor 1330 receives the color correction data stored in the memory 135 and performs the color correction for the input image signal IS by using the color correction data.

In such an embodiment, the second data processor 1332 performs the image processing for the input image signal IS that is processed in the first data processor 1330. The second data processor 1332 may process the input image signal IS based on the clock signal CLK. In one exemplary embodiment, for example, the second data processor 1332 performs the up-scaling for the color-corrected image signal.

In such an embodiment, the third data processor 1334 performs the image processing for the input image signal IS processed in the second data processor 1332. The third data processor 1334 may process the input image signal IS based on the clock signal CLK. In one exemplary embodiment, for example, the third data processor 1334 receives the previous frame image signal and the DCC data from the memory 135, and performs the DCC for the up-scaled image signal IS by using the previous frame image signal and the DCC data.

The transmitter 137 may output the input image signal IS received from the third data processor 1334 as the image data DATA. The transmitter 137 may further output the output control signal CONT.

The clock signal modulator 139 may receive the data enable signal DE and the main clock signal MCLK from the receiver 131. The clock signal modulator 139 may generate the clock signal CLK based on the data enable signal DE.

The clock signal modulator 139 may output the clock signal CLK to at least one of the first to third data processors 1330, 1332, and 1334 in the blank period. In an exemplary embodiment, the clock signal modulator 139 may output the clock signal CLK by at least one of the first data processor 1330 and the third data processor 1334 for performing the image processing by using the data stored in the memory 135.

In one exemplary embodiment, for example, the clock signal modulator 139 outputs the clock signal CLK to all of the first to third data processors 1330, 1332, and 1334 in the blank period. The first data processor 1330 may read the preset image signal with reference to the memory 135 in response to the clock signal CLK. The first data processor 1330 may also read the color correction data. The first data processor 1330 may correct the color of the read preset image signal. The first data processor 1330 may output the color-corrected preset image signal to the second data processor 1332. The second data processor 1332 may perform the up-scaling for the color-corrected preset image signal. The second data processor 1332 may output the up-scaled preset image signal to the third data processor 1334. The third data processor 1334 may read the previous frame image signal and the DCC data from the memory 135. The third data processor 1334 may perform the active capacitance compensation for the up-scaled preset image signal.

In one alternative exemplary embodiment, for example, the clock signal modulator 139 outputs the clock signal CLK to the first and third data processors 1330 and 1334 that operate with reference to the data ID1 and ID2 stored in the memory 135 in the blank period. The first data processor 1330 may read the preset image signal with reference to the memory 135 by the clock signal CLK. The first data processor 1330 may also read the color correction data. The first data processor 1330 may correct the color of the read preset image signal. The first data processor 1330 may output the color-corrected preset image signal to the second data processor 1332. Since the clock signal CLK is not input to the second data processor 1332, the color correction is not processed for the preset image signal. The third data processor 1334 may read the previous frame image signal, the preset image signal, and the DCC data from the memory 135. The third data processor 1334 may perform the active capacitance compensation for the preset image signal by using the previous frame image signal and the DCC data.

In one alternative exemplary embodiment, for example, the clock signal modulator 139 outputs the clock signal CLK to the first data processor 1330 or the third data processor 1334 in the blank period. In such an embodiment, since an operation thereof is the same as those described above, and any repetitive detailed description thereof will be omitted.

In an exemplary embodiment, the data generated in the blank period may not be output to the transmitter 137 as described in FIG. 4. In an exemplary embodiment, the processed data may be input to the transmitter 137, but the transmitter 137 may not output the processed data. In an exemplary embodiment, the processed data may be input to the transmitter 137, but the transmitter 137 may not output the gate control signal CONT2.

In such an embodiment, the image-processed data and control signals are not displayed on the display panel 100 in the blank period.

According to exemplary embodiments of the display device 10 and the driving method of the display device 10, the clock signal CLK is selectively applied to the first to third data processors 1330, 1332, and 1334 during the blank period, and the first and third data processors 1330 and 1334 may process the data ID1 and ID2 stored in the memory 135. In such embodiments, since the data ID1 and ID2 are processed by the first and third data processor 1330 and 1334 during the blank period, the signal controller 130' operate with the relatively high load. Accordingly, in such embodiment, the signal controller 130' that operates with the high load during the active period also operates with the relatively high load even in the blank period, such that the ripple of the operation voltage VDD generated depending on the load change may decrease.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display panel including a plurality of pixels; and a signal controller which generates, on a frame-by-frame basis, a display signal based on an input image signal and a control signal from an outside, wherein the signal controller comprises:

a memory which stores a preset image signal, a receiver which receives the control signal, wherein an active period is a period in which the control signal is varied between an enable level and a disable level in a frame period, and a blank period is a period in which the control signal is sustained at the disable level in the frame period, a clock signal modulator which generates an internal clock signal having a first frequency during the blank period, and a data processor which performs an image processing for the input image signal in the active period, reads the preset image signal from the memory during the blank period in response to the internal clock signal and performs the image processing for the preset image signal during the blank period, wherein image data, in which the preset image signal is image-processed, is not output from the signal controller during the blank period, and image data, in which the preset image signal is image-processed during the active period, is output from the signal controller during the active period.

2. The display device of claim 1, wherein the control signal includes:

a data enable signal including a pulse having an enable level during the active period and a pulse having a disable level during the blank period, wherein the active period is a remaining period in the frame period other than the blank period, and a main clock signal having a frequency equal to or higher than the first frequency.

3. The display device of claim 1, wherein the internal clock signal has a frequency equal to or higher than the first frequency during the active period, which is determined based on the control signal in the frame period.

4. The display device of claim 3, wherein the data processor performs the image processing for the input image signal during the active period, and the signal controller further comprises a transmitter which outputs the input image signal after the data processor performs the image processing therefor.

5. The display device of claim 1, wherein the first frequency of the internal clock signal varies during the blank period.

6. The display device of claim 5, wherein the clock signal has at least three different frequencies during the blank period.

7. The display device of claim 1, wherein the image processing includes at least one of a color correction, a luminance non-uniformity correction, a color characteristic compensation and a dynamic capacitance compensation.

8. The display device of claim 1, wherein the memory stores the input image signal of a previous frame, which is input to the signal controller, as the preset image signal.

9. The display device of claim 1, wherein the memory stores the input image signal of a previous frame, for which the image processing is performed by the data processor, as the preset image signal.

10. The display device of claim 1, wherein the memory further stores correction data to be used for the image processing, and the data processor includes:

a first data processor which performs the image processing with reference to the correction data of the memory; and a second data processor which performs the image processing without reference to the memory.

11. The display device of claim 10, wherein the clock signal modulator outputs only the internal clock signal to the first data processor during the blank period.

12. A driving method of a display device including a display panel and a signal controller, the method comprising:

receiving a control signal from an outside by the signal controller;

determining a blank period in a frame period by the signal controller based on the control signal;

generating an internal clock signal having a first frequency by the signal controller during the blank period; and reading a preset image signal from a memory of the signal controller during an active period and the blank period in response to the internal clock signal by the signal controller and performing an image processing for the preset image signal by the signal controller during the active period and the blank period, wherein image data, in which the preset image signal is image-processed, is not output from the signal controller during the blank period, and image data, in which the preset image signal is image-processed during the active period, is output from the signal controller during the active period.

13. The driving method of claim 12, wherein the signal controller generates an internal clock signal having a frequency equal to or higher than the first frequency during the active period, which is a remaining period in the frame period other than the blank period.

14. The driving method of claim 13, further comprising:

receiving the input image signal from the outside by the signal controller, wherein the signal controller performs the image processing for the input image signal during the active period to be output to the display panel.

15. The driving method of claim 12, wherein the first frequency of the internal clock signal varies during the blank period.

16. The driving method of claim 15, wherein the clock signal has at least three different frequencies during the blank period.

17. The driving method of claim 12, wherein the image processing includes at least one of a color correction, luminance non-uniformity correction, a color characteristic compensation and a dynamic capacitance compensation.

* * * * *